US011634671B2

(12) United States Patent
Sun et al.

(10) Patent No.: US 11,634,671 B2
(45) Date of Patent: Apr. 25, 2023

(54) STRUCTURED LIQUID DETERGENT COMPOSITIONS THAT INCLUDE A BACTERIAL-DERIVED CELLULOSE NETWORK

(71) Applicant: Henkel AG & Co. KGaA, Duesseldorf (DE)

(72) Inventors: Wei Sun, Trumbull, CT (US); Janet Coope-Epstein, Trumbull, CT (US); Sofia S. Christakos, Milford, CT (US)

(73) Assignee: Henkel AG & Co. KGaA, Duesseldorf (DE)

( * ) Notice: Subject to any disclaimer, the term of this patent is extended or adjusted under 35 U.S.C. 154(b) by 23 days.

(21) Appl. No.: 16/553,508

(22) Filed: Aug. 28, 2019

(65) Prior Publication Data

US 2021/0062118 A1 Mar. 4, 2021

(51) Int. Cl.

| | |
|---|---|
| ***C11D 1/14*** | (2006.01) |
| ***C11D 1/22*** | (2006.01) |
| ***C11D 1/66*** | (2006.01) |
| ***C11D 1/90*** | (2006.01) |
| ***C11D 17/00*** | (2006.01) |
| ***C11D 1/29*** | (2006.01) |
| ***C11D 1/72*** | (2006.01) |
| ***C11D 1/83*** | (2006.01) |
| ***C11D 3/04*** | (2006.01) |
| ***C11D 3/20*** | (2006.01) |
| ***C11D 3/22*** | (2006.01) |
| ***C11D 3/30*** | (2006.01) |

(Continued)

(52) U.S. Cl.

CPC ..... *C11D 17/0026* (2013.01); *C11D 1/02* (2013.01); *C11D 1/22* (2013.01); *C11D 1/29* (2013.01); *C11D 1/66* (2013.01); *C11D 1/72* (2013.01); *C11D 1/83* (2013.01); *C11D 1/90* (2013.01); *C11D 1/94* (2013.01); *C11D 3/04* (2013.01); *C11D 3/2086* (2013.01); *C11D 3/222* (2013.01); *C11D 3/30* (2013.01); *C11D 3/33* (2013.01)

(58) Field of Classification Search

CPC .... C11D 1/02; C11D 1/66; C11D 1/83; C11D 1/90; C11D 1/94; C11D 3/222

USPC ..... 510/350, 351, 356, 357, 470, 499, 505, 510/506

See application file for complete search history.

(56) References Cited

U.S. PATENT DOCUMENTS

| | | | |
|---|---|---|---|
| 7,776,807 | B2 | 8/2010 | Canto et al. |
| 7,888,308 | B2 | 2/2011 | Swazey |

(Continued)

FOREIGN PATENT DOCUMENTS

| | | | |
|---|---|---|---|
| EP | 2431451 | A1 | 3/2012 |
| WO | 2009101545 | A1 | 8/2009 |

OTHER PUBLICATIONS

European Search Report App. No. 20191845.5-1105 dated: Jan. 14, 2021 74 pages.

*Primary Examiner* — Gregory R Delcotto

(74) *Attorney, Agent, or Firm* — Bojuan Deng

(57) ABSTRACT

A structured liquid detergent composition includes water, an anionic detergent surfactant, and a nonionic detergent surfactant. A ratio of the anionic detergent surfactant to the nonionic detergent surfactant is from about 0.5 to about 20. The structured liquid detergent composition further includes a zwitterionic or amphoteric surfactant and a bacterial-derived cellulose network. The structured liquid detergent composition exhibits improved rheological properties.

11 Claims, 10 Drawing Sheets

(51) Int. Cl.

| | |
|---|---|
| ***C11D 3/33*** | (2006.01) |
| ***C11D 1/94*** | (2006.01) |
| ***C11D 1/02*** | (2006.01) |

(56) References Cited

U.S. PATENT DOCUMENTS

| | | | | |
|---|---|---|---|---|
| 7,981,855 | B1 | 7/2011 | Palla-Venkata et al. | |
| 8,546,318 | B2 * | 10/2013 | D'Ambrogio ..... | C11D 3/222<br>510/470 |
| 8,642,529 | B2 | 2/2014 | Palla-Venkata et al. | |
| 8,716,213 | B2 | 5/2014 | Caggioni et al. | |
| 9,045,716 | B2 | 6/2015 | Swazey et al. | |
| 2008/0108714 | A1 | 5/2008 | Swazey et al. | |
| 2012/0309662 | A1 * | 12/2012 | D'Ambrogio ..... | A61K 8/731<br>510/218 |
| 2015/0159120 | A1 * | 6/2015 | Fernandez-Prieto ..... | C11D 3/38636<br>435/204 |

* cited by examiner

STRUCTURED LIQUID DETERGENT COMPOSITIONS THAT INCLUDE A BACTERIAL-DERIVED CELLULOSE NETWORK

FIELD OF THE INVENTION

The technical field relates to structured liquid detergent compositions. More particularly, the present disclosure relates to structured liquid detergent compositions that include a bacterial-derived cellulose network and a specific ratio of anionic to non-ionic along with the existence of zwitterionic and/or amphoteric surfactants.

BACKGROUND OF THE INVENTION

Manufacturers of detergent compositions such as laundry detergent compositions, fabric softening compositions, detergent boosters, dishwasher detergent compositions, and the like continually endeavor to improve the performance of the detergent compositions in various ways. In addition to seeking to improve laundering effectiveness of the detergent compositions for removing various types of foreign substances from stained fabric articles, efforts have long been made to provide secondary effects attributable to the detergent compositions, such as delayed release of desirable active agents including fragrance, skin care, and/or textile care components. The delayed release of the active agents provides a long-lasting, persistent effect attributable to use of the detergent compositions.

To provide the delayed release of the active agents, many detergent compositions are formulated to include particulate components, such as microcapsules that deliver the active agents. The microcapsules may provide special delayed release functions such as heat release, mechanical release or other processing-dependent release functions. While microcapsules are a common type of particle included in detergent compositions, it is to be appreciated that various other agents in particle form are also desirably delivered in the detergent compositions.

When the detergent compositions are in liquid form, the microcapsules and other components in particle form are desirably dispersed within a liquid phase of the detergent compositions. However, the particulate components within the detergent compositions may have a tendency to settle out of the liquid phase of the detergent compositions, resulting in inconsistent properties of the detergent compositions. Therefore, it is desirable to provide the detergent compositions with a sufficiently high viscosity to minimize Brownian movement of particulate components within the detergent compositions and to maintain the particulate components in suspension within the liquid detergent compositions for an appreciable amount of time after forming the detergent compositions.

Efforts have been made to add structuring agents into liquid detergent compositions, with the structuring agents providing non-Newtonian shear thinning properties to the liquid detergent compositions once added. Cellulose has been suggested as a structuring agent, and it has been shown to be suitable over a broad pH range as well as having good compatibilities with laundry detergents in particular. There are two types of cellulose material that have been reported in structured liquid detergent compositions: (1) conventional microcrystalline cellulose that is derived from plant sources; and (2) micro-fibrous cellulose that are derived from bacteria. It has been found that bacterial-derived cellulose provides higher surface area compared to plant derived cellulose, which in turn delivers better cost efficiency due to lower inclusion level can be achieved with the use of bacterial-derived cellulose.

However, bacterial-derived cellulose has much more delicate structural network because the reticulated network is build up by nano-fibers with much smaller cross-sectional dimensions compared to conventional plant derived cellulose. Bacterial-derived cellulose, therefore, usually results into a relatively lower yield stress and smaller storage modulus, which can be more susceptible to flocculation due to the net forces between gravitational and buoyance differences applied from any suspended actives, such as oil particles or air particles.

Accordingly, in view of the foregoing, it is desirable to provide a structured liquid detergent composition that includes a bacterial-derived cellulose network, that delivers significantly improved structural network in terms of yield stress, storage modulus and low shear viscosity compared to what exhibited in the prior art structured liquid detergent compositions. Furthermore, other desirable features and characteristics will become apparent from the subsequent detailed description and the appended claims, taken in conjunction with the accompanying drawings and the foregoing technical field and background.

BRIEF SUMMARY OF THE INVENTION

It has been discovered by the inventors herein that a structured liquid detergent composition may use a bacterial-derived cellulose network for structuring purposes while avoiding the problems of relatively lower yield stress and relatively smaller storage modulus of the liquid detergent composition includes a specific ratio of anionic to non-ionic surfactant, along with a zwitterionic and/or amphoteric surfactant. Such liquid detergent compositions have been shown to provide surprisingly better rheological properties in terms of storage modulus G', yield stress, and low-shear viscosity compared to known detergent compositions. As such, the structured liquid detergents disclosed herein are useful for significant stability improvement of particle components in suspension using bacterial-derived cellulose network, while at the same time requiring lower structuring agent inclusion levels for cost efficiencies.

Accordingly, in one embodiment, disclosed herein is a structured liquid detergent composition that includes water, an anionic detergent surfactant, and a nonionic detergent surfactant. A ratio of the anionic detergent surfactant to the nonionic detergent surfactant is from about 0.5 to about 20. The structured liquid detergent composition further includes a zwitterionic or amphoteric surfactant and a bacterial-derived cellulose network.

In another embodiment, disclosed herein is a structured liquid detergent composition that includes, by weight of the overall structured liquid detergent composition, water in an amount of about 50% to about 95%, an anionic detergent surfactant in an amount of about 0.1% to about 30%, and a nonionic detergent surfactant in an amount of about 1% to about 30%. A ratio of the anionic detergent surfactant to the nonionic detergent surfactant is from about 0.5 to about 20. The structured liquid detergent composition further includes a zwitterionic or amphoteric detergent surfactant in an amount of about 0.1% to about 30% and a bacterial-derived cellulose network in an amount of about 0.002% to about 0.2%.

In yet another embodiment, disclosed herein is a structured liquid detergent composition that includes, by weight of the overall structured liquid detergent composition, water in an amount of about 70% to about 90%, an anionic detergent surfactant in an amount of about 0.5% to about 20%, and a nonionic detergent surfactant in an amount of about 5% to about 20%. A ratio of the anionic detergent surfactant to the nonionic detergent surfactant is from about 0.5 to about 15. The structured liquid detergent composition further includes a zwitterionic or amphoteric detergent surfactant in an amount of about 0.5% to about 20%, a bacterial-derived cellulose network in an amount of about 0.005% to about 0.1%, and an additive comprising one or more of: enzymes, peroxy compounds, bleach activators, anti-redeposition agents, neutralizers, optical brighteners, foam inhibitors, chelators, dye transfer inhibitors, soil release agents, water softeners, electrolytes, pH regulators, graying inhibitors, anti-crease components, bleach agents, colorants, scents, processing aids, antimicrobial agents, and preservatives.

This brief summary is provided to describe select concepts in a simplified form that are further described in the detailed description. This brief summary is not intended to identify key or essential features of the claimed subject matter, nor is it intended to be used as an aid in determining the scope of the claimed subject matter.

BRIEF DESCRIPTION OF THE DRAWINGS

The present disclosure will hereinafter be described in conjunction with the following Drawing figures, wherein like numerals denote like elements, and wherein.

DETAILED DESCRIPTION OF THE INVENTION

Figure 1:
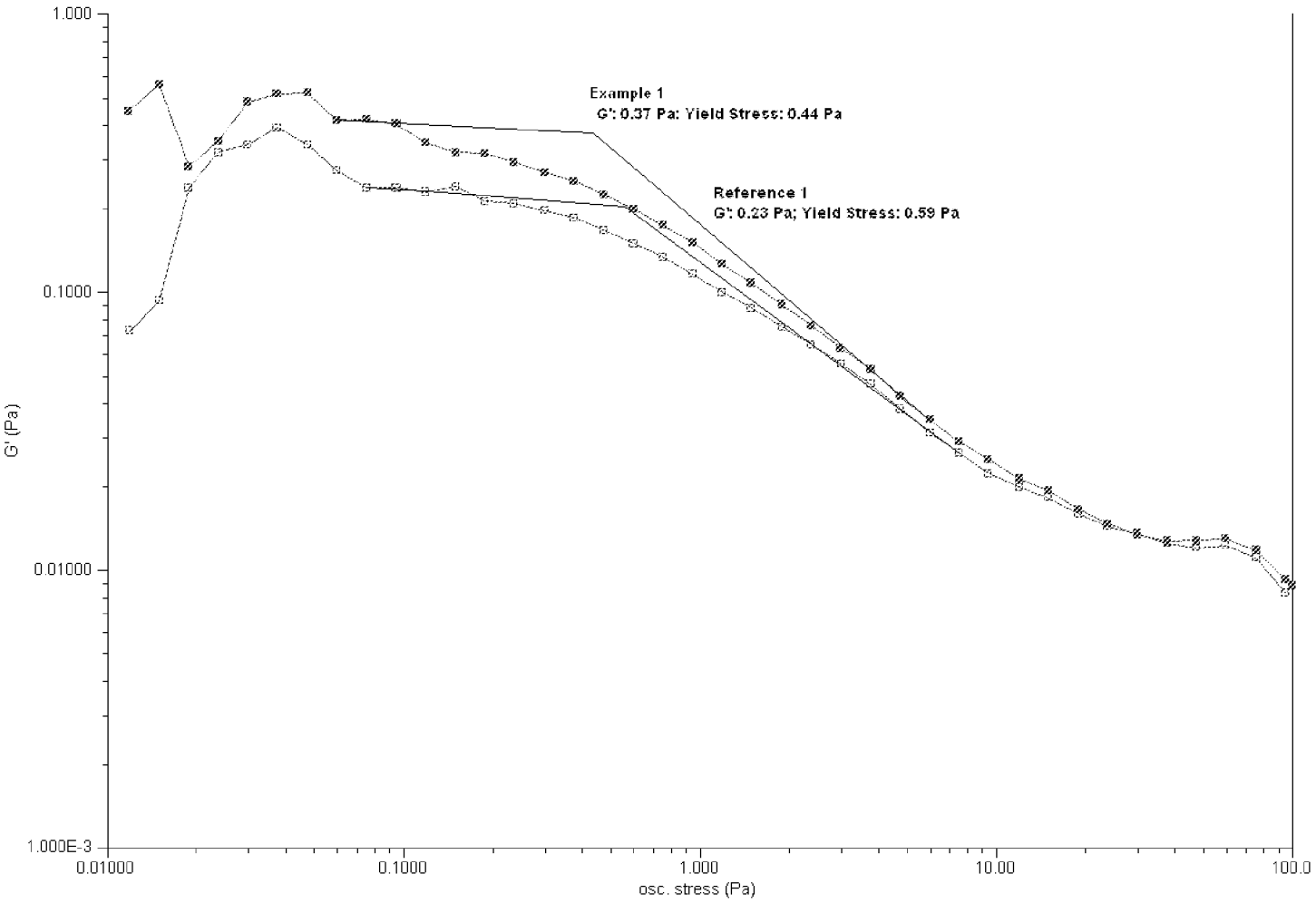
FIGS. 1-10 are graphs depicting certain rheological properties of the inventive and reference Example structured liquid detergent compositions described in greater detail below in the Illustrative Examples section of the present disclosure.

The following detailed description is merely exemplary in nature and is not intended to limit the composition, or the method for producing or using the same. Furthermore, there is no intention to be bound by any theory presented in the preceding background or the following detailed description.

As used herein, the articles "a," "an," and "the" can be used herein to refer to one or to more than one (i.e., to at least one) of the grammatical object of the article, unless the language and/or context clearly indicates otherwise. By way of example, "an element" means one element or more than one element. Furthermore, as used herein, the term "about" as used in connection with a numerical value throughout the specification and the claims denotes an interval of accuracy, familiar and acceptable to a person skilled in the art. In general, such interval of accuracy is ±10%. Thus, "about ten" means 9 to 11. All numbers in this description indicating amounts, ratios of materials, physical properties of materials, and/or use are to be understood as modified by the word "about," except as otherwise explicitly indicated. As an additional matter, all percentage amounts of the components of the laundry detergent composition are by weight percent of the overall composition, unless otherwise specified.

Structured Liquid Detergent

The present disclosure generally relates to structured detergent compositions that include a bacterial-derived cellulose network and a specific ratio of anionic to non-ionic to zwitterionic and/or amphoteric surfactants. As used herein, the term "detergent" is defined as any substance or preparation containing soaps and/or other surfactants intended for washing and cleaning processes. Thus detergents are cleansing agents that can emulsify oils and hold dirt in suspension. More particularly, in one exemplary embodiment, "laundry detergent" refers to any type of detergent (cleaning agent) that is added for cleaning laundry.

The structured liquid detergents, in an embodiment, include anywhere from about 50% water to about 95% by weight water as solvent, such as from about 70% water to about 90% water, or from about 80% water to about 90% water. In further embodiment, the structure liquid detergents include from about 50% to about 60% by weight water, from about 60% to about 70% water, from about 70% to about 80% water, or from about 80% to about 95% water.

Anionic Surfactant

As initially noted above, the structured liquid detergent compositions of the present disclosure contain anionic detergent surfactants. The anionic detergent surfactant may be present in the structured detergent composition at a concentration of from about 0.1% to about 30% by weight in one embodiment, but the anionic detergent surfactant may be present in the structured detergent composition at a concentration of about 0.5% to about 20% or from about 1% to about 15% in alternate embodiments, or from about 2% to about 10%, where weight percentages are based on a total weight of the structured detergent composition. The anionic detergent surfactant may alternatively be present in an amount of about 0.1% to about 20% by weight, from about 0.1% to about 15%, or from about 0.5% to about 15%.

Suitable anionic detergent surfactants include soaps that contain sulfate or sulfonate groups, including those with alkali metal ions as cations. Usable soaps include alkali metal salts of saturated or unsaturated fatty acids with 12 to 18 carbon (C) atoms. Such fatty acids may also be used in incompletely neutralized form. Usable anionic detergent surfactants of the sulfate type include the salts of sulfuric acid semi esters of fatty alcohols with 12 to 18 C atoms, and/or alcohol ethoxysulfates. Usable anionic detergent surfactants of the sulfonate type include alkane sulfonates with 12 to 18 C atoms and olefin sulfonates with 12 to 18 C atoms, such as those that arise from the reaction of corresponding mono-olefins with sulfur trioxide, alpha-sulfofatty acid esters such as those that arise from the sulfonation of fatty acid methyl or ethyl esters, and lauryl ether sulfates.

In some embodiments, the anionic surfactant is a polyethoxylated alcohol sulfate, such as those sold under the trade name CALFOAM® 303 (Pilot Chemical Company, California). Such materials, also known as alkyl ether sulfates (AES) or alkyl polyethoxylate sulfates, are those which correspond to the following formula (XIII):

$$R'—O—(C2H40)n\text{-}SO3M' \quad \text{(XIII)}$$

wherein R' is a C8-C20 alkyl group, n is from 1 to 20, and M' is a salt-forming cation, preferably, R' is C10-C18 alkyl, n is from 1 to 15, and M' is sodium, potassium, ammonium, alkylammonium, or alkanolammonium. In another embodiment, R' is a C12-C16 alkyl, n is from 1 to 6 and M' is sodium. In another embodiment, the alkyl ether sulfate is sodium lauryl ether sulphate (SLES).

In some embodiments, the anionic surfactant can be linear alkylbenzene sulfonic acid (LAS) or a salt thereof, alkyl ethoxylated sulphate, alkyl propoxy sulphate, alkyl sulphate, or a mixture thereof. Linear alkylbenzenesulfonate (LAS) is a water soluble salt of a linear alkyl benzene sulfonate having between 8 and 22 carbon atoms of the linear alkyl group. The salt can be an alkali metal salt, or an ammonium, alkylammonium, or alkanolammonium salt. In one embodiment, the LAS comprises an alkali metal salt of $C_{10}$-$C_{16}$ alkyl benzene sulfonic acids, such as $C_{11}$-$C_{14}$ alkyl benzene sulfonic acids.

Non-Ionic Surfactant

Nonionic detergent surfactant(s) are present in the structured detergent composition of the present disclosure. The nonionic detergent surfactant may be present in the detergent composition at a concentration of from about 1% to about 30% by weight in one embodiment, but the nonionic detergent surfactant may be present in the structured detergent composition at a concentration of about 5% to about 20% or from about 10% to about 15% in alternate embodiments, or from about 2% to about 30%, where weight percentages are based on a total weight of the structured detergent composition. The nonionic detergent surfactant may alternatively be present in an amount of about 1% to about 15% by weight, from about 2% to about 15%, or from about 5% to about 15%.

Suitable nonionic detergent surfactants include alkyl glycosides and ethoxylation and/or propoxylation products of alkyl glycosides or linear or branched alcohols in each case having 12 to 18 C atoms in the alkyl moiety and 3 to 20, or 4 to 10, alkyl ether groups. Corresponding ethoxylation and/or propoxylation products of N-alkylamines, vicinal diols, fatty acid esters and fatty acid amides, which correspond to the alkyl moiety in the stated long-chain alcohol derivatives, may furthermore be used. Alkylphenols having 5 to 12 C atoms may also be used in the alkyl moiety of the above described long-chain alcohol derivatives.

Examples of nonionic surfactants suitable for the present invention include, but are not limited to, polyalkoxylated alkanolamides, polyoxyalkylene alkyl ethers, polyoxyalkylene alkylphenyl ethers, polyoxyalkylene sorbitan fatty acid esters, polyoxyalkylene sorbitol fatty acid esters, polyoxyethylene polyoxypropylene alkyl ethers, polyoxyalkylene castor oils, polyoxyalkylene alkylamines, glycerol fatty acid esters, alkylglucosamides, alkylglucosides, alkylamine oxides, amine oxide surfactants, alkoxylated fatty alcohols, or a mixture thereof. In some embodiments, the nonionic surfactant is alcohol ethoxylate (AE), alcohol propoxylate, or a mixture thereof. In other embodiments, the nonionic surfactant is AE.

The AE may be primary and secondary alcohol ethoxylates, especially the $C_8$-$C_{20}$ aliphatic alcohols ethoxylated with an average of from 1 to 20 moles of ethylene oxide per mole of alcohol, and more especially the $C_{10}$-$C_{15}$ primary and secondary aliphatic alcohols ethoxylated with an average of from 1 to 10 moles, or from 3 to 8 moles of ethylene oxide per mole of alcohol.

Exemplary AEs are the condensation products of aliphatic $C_8$-$C_{20}$, preferably $C_8$-$C_{16}$, primary or secondary, linear or branched chain alcohols with ethylene oxide. In some embodiments, the alcohol ethoxylates contain 1 to 20, or 3 to 8 ethylene oxide groups, and may optionally be end-capped by a hydroxylated alkyl group.

In one embodiment, the AE has Formula (XIV):

$$R_2—(—O—C_2H_4-)_m—OH \quad \text{(XIV)}$$

wherein $R_2$ is a hydrocarbyl group having 8 to 16 carbon atoms, 8 to 14 carbon atoms, 8 to 12 carbon atoms, or 8 to 10 carbon atoms; and m is from 1 to 20, or 3 to 8.

The hydrocarbyl group may be linear or branched, and saturated or unsaturated. In some embodiments, $R_2$ is a linear or branched $C_8$-$C_{16}$ alkyl or a linear group or branched $C_8$-$C_{16}$ alkenyl group. Preferably, $R_2$ is a linear or branched $C_8$-$C_{16}$ alkyl, $C_8$-$C_{14}$ alkyl, or $C_8$-$C_{10}$ alkyl group. In case (e.g., commercially available materials) where materials contain a range of carbon chain lengths, these carbon numbers represent an average. The alcohol may be derived from natural or synthetic feedstock. In one embodiment, the alcohol feedstock is coconut, containing predominantly $C_{12}$-$C_{14}$ alcohol, and oxo $C_{12}$-$C_{15}$ alcohols.

One suitable AE is Tomadol® 25-7 (available from Air Product). Other suitable AEs include Genapol® C200 (available from Clariant), which is a coco alcohol having an average degree of ethoxylation of 20.

Zwitterionic/Amphoteric Surfactant

The zwitterionic and/or amphoteric detergent surfactant(s) may be present in the structured detergent composition at a concentration of from about 0.1% to about 30% by weight in one embodiment, but the zwitterionic and/or amphoteric detergent surfactant(s) may be present in the structured detergent composition at a concentration of about 0.5% to about 20% or from about 1% to about 15% in alternate embodiments, or from about 2% to about 10%, where weight percentages are based on a total weight of the structured detergent composition. The zwitterionic and/or amphoteric detergent surfactant(s) may alternatively be present in an amount of about 0.1% to about 20% by weight, from about 0.1% to about 10%, or from about 0.5% to about 5%.

Amphoteric surfactants suitable for use in the composition include those surfactants broadly described as derivatives of aliphatic secondary and tertiary amines in which the aliphatic radical can be straight or branched chain and wherein one of the aliphatic substituents contains from 8 to 18 carbon atoms and one contains an anionic group such as carboxy, sulfonate, sulfate, phosphate, or phosphonate. Exemplary amphoteric detergent surfactants for use in the present invention include cocoamphoacetate, cocoamphodiacetate, lauroamphoacetate, lauroamphodiacetate, and mixtures thereof.

Zwitterionic surfactants suitable for use in the compositions are well known in the art, and include those surfactants broadly described as derivatives of aliphatic quaternary ammonium, phosphonium, and sulfonium compounds, in which the aliphatic radicals can be straight or branched chain, and wherein one of the aliphatic substituents contains from 8 to 18 carbon atoms and one contains an anionic group, for example but not limited to carboxy, sulfonate, sulfate, phosphate or phosphonate. Zwitterionics such as betaines are suitable for this invention.

In one particular embodiment, the zwitterionic and/or amphoteric detergent surfactant may be cocoamidopropyl betaine (CAPB), which is mixture of organic compounds derived from coconut oil and dimethylaminopropylamine. CAPB has as its majority constituent lauramidopropyl betaine, which is a zwitterion consisting of both a quaternary ammonium cation and a carboxylate.

Surfactant Ratio

In accordance with the present disclosure, a weight ratio of the anionic surfactant to the nonionic surfactant (i.e., wt. % anionic/wt. % nonionic) is from about 0.5 to about 20, such as from about 0.5 to about 15, or from about 2 to about 20, or from about 2 to about 15. In particular embodiments, the ratio may be from about 0.5 to about 5, or from about 5 to about 10, or from about 10 to about 15.

Furthermore, in accordance with the present disclosure, a weight ratio of the anionic surfactant to the amphoteric/zwitterionic surfactant (i.e., wt. % anionic to wt. % amphoteric/zwitterionic) is from about 1 to about 20, such as from about 1 to about 15, or from about 2 to about 20, or from about 2 to about 15. In particular embodiments, the ratio may be from about 1 to about 5, or from about 5 to about 10, or from about 10 to about 15, or from about 15 to about 20.

Bacterial-Derived Cellulose Network

As initially noted above, the liquid detergent of the present disclosure is structured using a bacterial-derived cellulose network. The structuring system of the present disclosure thus includes a bacterial cellulose network at a level of up to about 100%, alternatively up to about 99%, alternatively up to about 95%, alternatively up to about 80%, alternatively up to about 70% by weight of said external structuring system. The term "bacterial cellulose" is intended to encompass any type of cellulose produced via fermentation of a bacteria of the genus *Acetobacter* and includes materials referred popularly as microfibrillated cellulose, reticulated bacterial cellulose, the like, or a combination thereof.

The bacterial cellulose network is formed by processing of a mixture of the bacterial cellulose in a hydrophilic solvent, such as water, polyols (e.g., ethylene glycol, glycerin, polyethylene glycol, etc.), or mixtures thereof. This processing is called "activation" and comprises, generally, high pressure homogenization and/or high shear mixing. It has importantly been found that activating the bacterial cellulose under sufficiently intense processing conditions provides for increased yield stress at given levels of bacterial cellulose network. Yield stress, as defined below, is a measure of the force required to initiate flow in a gel-like system. It is believed that yield stress is indicative of the suspension ability of the liquid composition, as well as the ability to remain in situ after application to a vertical surface.

Activation is a process in which the 3-dimensional structure of the bacterial cellulose is modified such that the cellulose imparts functionality to the base solvent or solvent mixture in which the activation occurs, or to a composition to which the activated cellulose is added. Functionality includes providing such properties as shear-thickening, imparting yield stress-suspension properties, freeze-thaw and heat stability, and the like. The processing that is followed during the activation process does significantly more than to just disperse the cellulose in base solvent. Such intense processing "teases apart" the cellulose fibers to expand the cellulose fibers. The activation of the bacterial cellulose expands the cellulose portion to create a bacterial cellulose network, which is a reticulated network of highly intermeshed fibers with a very high surface area. The activated reticulated bacterial cellulose possesses an extremely high surface area that is thought to be at least 200-fold higher than conventional microcrystalline cellulose (i.e., cellulose provided by plant sources).

The bacterial cellulose utilized herein may be of any type associated with the fermentation product of *Acetobacter* genus microorganisms, and is available, in one example, from CPKelco U.S. as CELLULON®. Such aerobic cultured products are characterized by a highly reticulated, branching interconnected network of fibers that are insoluble in water. The preparation of such bacterial cellulose products are well known and typically involve a method for producing reticulated bacterial cellulose aerobically, under agitated culture conditions, using a bacterial strain of *Acetobacter aceti* var. *xylinum*. Use of agitated culture conditions results in sustained production, over an average of 70 hours, of at least 0.1 g/liter per hour of the desired cellulose. Wet cake reticulated cellulose, containing approximately 80-85% water, can be produced using the methods and conditions disclosed in the above-mentioned patents. Dry reticulated bacterial cellulose can be produced using drying techniques, such as spray-drying or freeze-drying, among others for example.

*Acetobacter* is characteristically a gram-negative, rod shaped bacterium 0.6-0.8 microns by 1.0-4 microns. It is a strictly aerobic organism; that is, metabolism is respiratory, not fermentative. This bacterium is further distinguished by the ability to produce multiple poly β-1,4-glucan chains, chemically identical to cellulose. The microcellulose chains, or microfibers, of reticulated bacterial cellulose are synthesized at the bacterial surface, at sites external to the cell membrane. These microfibers have a cross sectional dimensions of about 1.6 nm to about 3.2 nm by about 5.8 nm to about 133 nm. In one embodiment, the bacterial cellulose network has a widest cross sectional microfiber width of from about 1.6 nm to about 200 nm, alternatively less than about 133 nm, alternatively less than about 100 nm, alternatively less than about 5.8 nm. Additionally, the bacterial cellulose network has an average microfiber length of at least 100 nm, alternatively from about 100 to about 1500 nm. In one embodiment, the bacterial cellulose network has a microfiber aspect ratio, meaning the average microfiber length divided by the widest cross sectional microfiber width, of from about 10:1 to about 1000:1, alternatively from about 100:1 to about 400:1, alternatively from about 200:1 to about 300:1.

The bacterial-derived cellulose network may be present in the structured liquid detergent composition in an amount from about 0.002% to about 0.2% by weight, such as from about 1% to about 3%, for example from about 1.5% to about 2%. In particular embodiments, the bacterial-derived cellulose network may be present in the structured liquid detergent composition in an amount from about 0.002% to about 0.005%, about 0.005% to about 0.01%, about 0.01% to about 0.05%, about 0.05% to about 0.1%, or about 0.1% to about 0.2%, by weight.

Additional Components

Several other components may optionally be added to and included in the structured detergent composition, including but not limited to enzymes, peroxy compounds, bleach activators, anti-redeposition agents, neutralizers, optical brighteners, foam inhibitors, chelators, dye transfer inhibitors, soil release agents, water softeners, and other components. A partial, non-exclusive list of additional components (not illustrated) that may be added to and included in the structured detergent composition include electrolytes, pH regulators, graying inhibitors, anti-crease components, bleach agents, colorants, scents, processing aids, antimicrobial agents, and preservatives.

Possible enzymes that may be in the structured detergent composition contemplated herein include one or more of a protease, lipase, cutinase, amylase, carbohydrase, cellulase, pectinase, mannanase, arabinase, galactanase, xylanase, and/or peroxidase, but others are also possible. In general, the properties of the selected enzyme(s) should be compatible with the selected structured detergent composition, (i.e., pH-optimum, compatibility with other enzymatic and non-enzymatic ingredients, etc.). The detergent enzyme(s) may be included in the structured detergent composition by adding separate additives containing one or more enzymes, or by adding a combined additive comprising all the enzymes that are added to the structured detergent composition. The enzyme(s) should be present in the structured detergent composition in effective amounts, such as from about 0 weight percent to about 5 weight percent of enzyme, or from about 0.001 to about 1 weight percent, or from about 0.2 to about 2 weight percent, or from about 0.5 to about 1 weight percent, based on the total weight of the structured detergent composition, in various embodiments.

As alluded to above, a peroxy compound may optionally be present in the structured detergent composition. Exemplary peroxy compounds include organic peracids or peracidic salts of organic acids, such as phthalimidopercaproic acid, perbenzoic acid or salts of diperdodecanedioic acid, hydrogen peroxide and inorganic salts that release hydrogen peroxide under the washing conditions, such as perborate, percarbonate and/or persilicate. Hydrogen peroxide may also be produced with the assistance of an enzymatic system, i.e. an oxidase and its substrate. Other possible peroxy compounds include alkali metal percarbonates, alkali metal perborate monohydrates, alkali metal perborate tetrahydrates or hydrogen peroxide. Peroxy compounds may be present in the structured detergent composition at an amount of from about 0 to about 50 weight percent, or an amount of from about 3 to about 30 weight percent, or an amount of from about 3 to about 10 weight percent, based on the total weight of the structured detergent composition, in various embodiments.

Bleach activators may optionally be added and included in the structured detergent composition. Conventional bleach activators that form peroxycarboxylic acid or peroxyimidic acids under perhydrolysis conditions and/or conventional bleach-activating transition metal complexes may be used. The bleach activator optionally present may include, but is not limited to, one or more of: N- or O-acyl compounds, for example polyacylated alkylenediamines, such as tetraacetylethylenediamine; acylated glycolurils, such as tetraacetylglycoluril; N-acylated hydantoins; hydrazides; triazoles; urazoles; diketo-piperazines; sulfurylamides and cyanurates; carboxylic anhydrides, such as phthalic anhydride; carboxylic acid esters, such as sodium isononanoylphenolsulfonate; acylated sugar derivatives, such as pentaacetyl glucose; and cationic nitrile derivatives such as trimethylammonium acetonitrile salts.

To avoid interaction with peroxy compounds during storage, the bleach activators may be coated with shell substances or granulated prior to addition to the structured detergent composition, in a known manner. As such, the bleach activator and/or other components may be present in a liquid structured detergent composition as a free or floating particulate. Exemplary embodiments of the coating or shell substance include tetraacetylethylenediamine granulated with the assistance of carboxymethylcellulose and having an average grain size of 0.01 mm to 0.8 mm, granulated 1,5-diacetyl-2,4-dioxohexahydro-1,3,5-triazine, and/or trialkylammonium acetonitrile formulated in particulate form. In alternative embodiments, the bleach activators may be enclosed in a compartment, separate from the compartment that contains peroxy compounds and/or other compounds of the structured detergent composition. In various embodiments, the bleach activators may be present in the structured detergent composition in quantities of from about 0 to about 8 weight percent, or from about 0 to about 6 weight percent, or from about 0 to about 4 weight percent, in each case relative to the total weight of the structured detergent composition.

One or more anti-redeposition agents may also be optionally included in the structured detergent composition. Anti-redeposition agents include polymers with a soil detachment capacity, which are also known as "soil repellents" due to their ability to provide a soil-repelling finish on the treated surface, such as a fiber. Anti-redeposition agents include polymers with a soil detachment capacity. One example in regard to polyesters includes copolyesters prepared from dicarboxylic acids, such as adipic acid, phthalic acid or terephthalic acid. In an exemplary embodiment, an anti-redeposition agents includes polyesters with a soil detachment capacity that include those compounds which, in formal terms, are obtainable by esterifying two monomer moieties, the first monomer being a dicarboxylic acid HOOC-Ph-COOH and the second monomer a diol HO—($CHR^{11}$-)aOH, which may also be present as a polymeric diol H—(O—($CHR^{11}$-)$_a$)$_b$OH. Ph here means an ortho-, meta- or para-phenylene residue that may bear 1 to 4 substituents selected from alkyl residues with 1 to 22 C atoms, sulfonic acid groups, carboxyl groups and mixtures thereof. RH means hydrogen or an alkyl residue with 1 to 22 C atoms and mixtures thereof "a" means a number from 2 to 6 and "b" means a number from 1 to 300. The polyesters obtainable therefrom may contain not only monomer diol units —O—($CHR^{11}$—)$_a$O— but also polymer diol units —(O—($CHR^{11}$-)$_a$)$_b$O—. The molar ratio of monomer diol units to polymer diol units may amount to from about 100:1 to about 1:100, or from about 10:1 to about 1:10 in another embodiment. In the polymer diol units, the degree of polymerization "b" may be in the range of from about 4 to about 200, or from about 12 to about 140 in an alternate embodiment. The average molecular weight of the polyesters with a soil detachment capacity may be in the range of from about 250 to about 100,000, or from about 500 to about 50,000 in an alternate embodiment. The acid on which the residue Ph is based may be selected from terephthalic acid, isophthalic acid, phthalic acid, trimellitic acid, mellitic acid, the isomers of sulfophthalic acid, sulfoisophthalic acid and sulfoterephthalic acid and mixtures thereof. Where the acid groups thereof are not part of the ester bond in the polymer, they may be present in salt form, such as an alkali metal or ammonium salt. Exemplary embodiments include sodium and potassium salts.

If desired, instead of the monomer HOOC-Ph-COOH, the polyester with a soil detachment capacity (the anti-redeposition agent) may include small proportions, such as no more than about 10 mole percent relative to the proportion of Ph with the above-stated meaning, of other acids that include at least two carboxyl groups. These include, for example, alkylene and alkenylene dicarboxylic acids such as malonic acid, succinic acid, fumaric acid, maleic acid, glutaric acid, adipic acid, pimelic acid, suberic acid, azelaic acid and sebacic acid. Exemplary diols HO—($CHR^{11}$-)$_a$OH include those in which $R^{11}$ is hydrogen and "a" is a number of from about 2 to about 6, and in another embodiment includes those in which "a" has the value of 2 and $R^{11}$ is selected from hydrogen and alkyl residues with 1 to 10 C atoms, or where $R^{11}$ is selected from hydrogen and alkyl residues with 1 to 3 C atoms in another embodiment. Examples of diol components are ethylene glycol, 1,2-propylene glycol, 1,3-propylene glycol, 1,4-butanediol, 1,5-pentanediol, 1,6-hexanediol, 1,8-octanediol, 1,2-decanediol, 1,2-dodecanediol and neopentyl glycol. The polymeric diols include polyethylene glycol with an average molar mass in the range from about 1000 to about 6000. If desired, these polyesters may also be end group-terminated, with end groups that may be alkyl groups with 1 to 22 C atoms or esters of monocarboxylic acids. The end groups attached via ester bonds may be based on alkyl, alkenyl and aryl monocarboxylic acids with 5 to 32 C atoms, or with 5 to 18 C atoms in another embodiment. These include valeric acid, caproic acid, enanthic acid, caprylic acid, pelargonic acid, capric acid, undecanoic acid, undecenoic acid, lauric acid, lauroleic acid, tridecanoic acid, myristic acid, myristoleic acid, pentadecanoic acid, palmitic acid, stearic acid, petroselinic acid, petroselaidic acid, oleic acid, linoleic acid, linolaidic acid, linolenic acid, eleostearic acid, arachidic acid, gadoleic acid, arachidonic acid, behenic acid, erucic acid, brassidic acid, clupanodonic acid, lignoceric acid, cerotic acid, melissic acid, benzoic acid, which may bear 1 to 5 substituents having a total of up to 25 C atoms, or 1 to 12 C atoms in another embodiment, for example tert-butylbenzoic acid. The end groups may also be based on hydroxymonocarboxylic acids with 5 to 22 C atoms, which for example include hydroxyvaleric acid, hydroxycaproic acid, ricinoleic acid, the hydrogenation product thereof, hydroxystearic acid, and ortho-, meta- and para-hydroxybenzoic acid. The hydroxymonocarboxylic acids may in turn be joined to one another via their hydroxyl group and their carboxyl group and thus be repeatedly present in an end group. The number of hydroxymonocarboxylic acid units per end group, i.e. their degree of oligomerization, may be in the range of from 1 to 50, or in the range of from 1 to 10 in another embodiment. In an exemplary embodiment, polymers of ethylene terephthalate and polyethylene oxide terephthalate, in which the polyethylene glycol units have molar weights of from about 750 to about 5000 and the molar ratio of ethylene terephthalate to polyethylene oxide terephthalate of from about 50:50 to about 90:10, are used alone or in combination with cellulose derivatives. The anti-redeposition agent is present in the structured detergent composition at an amount of from about 0 to about 3 weight percent, or an amount of from about 0 to about 2 weight percent, or an amount of from about 0 to about 1 weight percent, based on the total weight of the structured detergent composition, in various embodiments.

Neutralizers are optionally added to and included in the structured detergent composition. Exemplary neutralizers include, but are not limited to, sodium hydroxide, triethanol amine, monoethanol amine, buffers, or other compounds that adjusts the pH of the structured detergent composition. Neutralizers may be present in the structured detergent composition at an amount of from about 0 to about 5 weight percent in some embodiments, based on the total weight of the structured detergent composition, but in other embodiments the neutralizer may be present in the structured detergent composition at an amount of from about 0 to about 3 weight percent, or an amount of from about 0 to about 2 weight percent, based on the total weight of the structured detergent composition.

Optical brighteners may optionally be included in the structured detergent composition. Optical brighteners adsorb ultraviolet and/or violet light and re-transmit it as visible light, typically a visible blue light. Optical brighteners include, but are not limited to, derivatives of diaminostilbene disulfonic acid or the alkali metal salts thereof. Suitable compounds are, for example, salts of 4,4'-bis(2-anilino-4-morpholino-1,3,5-triazinyl-6-amino)stilbene 2,2'-disulfonic acid or compounds of similar structure which, instead of the morpholino group, bear a diethanolamino group, a methylamino group, an anilino group or a 2-methoxyethylamino group. Optical brighteners of the substituted diphenylstyryl type may furthermore be present, such as the alkali metal salts of 4,4'-bis(2-sulfostyryl)diphenyl, 4,4'-bis(4-chloro-3-sulfostyryl)diphenyl, or 4-(4-chlorostyryl)-4'-(2-sulfostyryl)diphenyl. Mixtures of the above-stated optical brighteners may also be used. Optical brighteners may be present in the structured detergent composition at an amount of from about 0 to about 1 weight percent in some embodiments, but in other embodiments optical brighteners are present in an amount of from about 0.01 to about 0.5 weight percent, or an amount of from about 0.05 to about 0.3 weight percent, or an amount of from 0.005 to about 5 weight percent, based on the total weight of the structured detergent composition.

Foam inhibitors may also optionally be included in the structured detergent composition. Suitable foam inhibitors include, but are not limited to, soaps of natural or synthetic origin, which include an elevated proportion of $C_{18}$-$C_{24}$ fatty acids. Suitable non-surfactant foam inhibitors are, for example, organopolysiloxanes and mixtures thereof with microfine, optionally silanized silica as well as paraffins, waxes, microcrystalline waxes and mixtures thereof with silanized silica or bis-fatty acid alkylenediamides. Mixtures of different foam inhibitors may also be used, for example mixtures of silicones, paraffins or waxes. In an exemplary embodiment, mixtures of paraffins and bistearylethylenediamide may be used. The structured detergent composition may include the foam inhibitor at an amount of from about 0 to about 5 weight percent, but in other embodiments the foam inhibitor may be present at an amount of from about 0.05 to about 3 weight percent, or an amount of from about 0.5 to about 2 weight percent, based on the total weight of the structured detergent composition.

Chelators bind and remove calcium, magnesium, or other metals from water, and may optionally be included in the structured detergent composition. Many compounds can be used as water softeners, including but not limited to ethylenediaminetetraacetic acid (EDTA), nitrilotriacetic acid, diethylenetriaminepenta(methylenephosphonic acid), nitrilotris(methylenephosphonic acid), 1-hydroxyethane-1,1-diphosphonic acid, iminodisuccinic acid (IDS), or other chelating agents. Chelators may be present in the structured detergent composition at an amount of from about 0 to about 5 weight percent in an exemplary embodiment, but in alternate embodiments the chelators are present at an amount of from about 0.01 to about 3 weight percent or an amount of from about 0.02 to about 1 weight percent, based on the total weight of the structured detergent composition.

In one embodiment, the structured detergent composition is a laundry detergent composition suitable for use in the washing of fabrics and/or garments. The fabrics and/or garments subjected to a washing, cleaning or textile care processes contemplated herein may be conventional washable laundry, such as household laundry. In some embodiments, the major part of the laundry is garments and fabrics, including but not limited to knits, woven fabrics, denims, non-woven fabrics, felts, yarns, and toweling. The fabrics may be cellulose based such as natural cellulosics, including cotton, flax, linen, jute, ramie, sisal or coir or manmade cellulosics (e.g., originating from wood pulp) including viscose/rayon, ramie, cellulose acetate fibers (tricell), lyocell or blends thereof. The fabrics may also be non-cellulose based such as natural polyamides including wool, camel, cashmere, mohair, rabbit, and silk, or the fabric may be a synthetic polymer such as nylon, aramid, polyester, acrylic, polypropylene and spandex/elastin, or blends of any of the above-mentioned products. Examples of blends are blends of cotton and/or rayon/viscose with one or more companion material such as wool, synthetic fibers (e.g., polyamide fibers, acrylic fibers, polyester fibers, polyvinyl alcohol fibers, polyvinyl chloride fibers, polyurethane fibers, polyurea fibers, aramid fibers), and cellulose-containing fibers (e.g., rayon/viscose, ramie, flax, linen, jute, cellulose acetate fibers, lyocell).

In one embodiment, the fabrics and/or garments are added to a washing machine, and the laundry detergent is also added to the washing machine before wash water is added. The fabrics and/or garments are laundered with the wash water and the laundry detergent. The fabrics and/or garments may then be dried and processed as normal.

ILLUSTRATIVE EXAMPLES

The present disclosure is now illustrated by the following non-limiting examples. It should be noted that various changes and modifications can be applied to the following examples and processes without departing from the scope of this disclosure, which is defined in the appended claims. Therefore, it should be noted that the following examples should be interpreted as illustrative only and not limiting in any sense.

Ten different laundry detergent compositions were prepared according to the foregoing description, five of which included 1% by weight of the zwitterionic surfactant CAPB as described above, whereas the remaining five were provided as a "Reference" examples and included none of the CAPB. TABLE 1, below, sets forth these ten examples in terms of weight percent of the ingredients:

TABLE 1

| Formula | Reference 1 | Example 1 | Reference 2 | Example 2 | Reference 3 | Example 3 | Reference 4 | Example 4 | Reference 5 | Example 5 |
|---|---|---|---|---|---|---|---|---|---|---|
| Alcohol Ethoxylated Sulfate Sodium Salt EO3 | 1 | 1 | 4 | 4 | 4.33 | 4.33 | 6 | 6 | 1 | 1 |
| Linear Alkylbenzene Sulfonate | 1 | 1 | 1.75 | 1.75 | 4.33 | 4.33 | 6 | 6 | 11 | 11 |
| Alcohol Ethoxylate (C25EO7) | 11 | 11 | 6.8 | 6.8 | 4.33 | 4.33 | 1 | 1 | 1 | 1 |
| CAPB | 0 | 1 | 0 | 1 | 0 | 1 | 0 | 1 | 0 | 1 |
| Coco Fatty Acid | 0.5 | 0.5 | 0.5 | 0.5 | 0.5 | 0.5 | 0.5 | 0.5 | 0.5 | 0.5 |
| Citric Acid | 2.5 | 2.5 | 2.25 | 2.25 | 2.5 | 2.5 | 2.5 | 2.5 | 2.5 | 2.5 |
| Iminodisuccinic acid | 0.33 | 0.33 | 0.33 | 0.33 | 0.33 | 0.33 | 0.33 | 0.33 | 0.33 | 0.33 |
| Trimethanolamine | 0.5 | 0.5 | 0.5 | 0.5 | 0.5 | 0.5 | 0.5 | 0.5 | 0.5 | 0.5 |
| $CaCl_2$ | 0.05 | 0.05 | 0.05 | 0.05 | 0.05 | 0.05 | 0.05 | 0.05 | 0.05 | 0.05 |
| Fragrance | 0.53 | 0.53 | 0.53 | 0.53 | 0.53 | 0.53 | 0.53 | 0.53 | 0.53 | 0.53 |
| Bacterial Cellulose | 0.015 | 0.015 | 0.02 | 0.02 | 0.015 | 0.015 | 0.015 | 0.015 | 0.015 | 0.015 |
| Anionic/Nonionic Surfactant Ratio | 0.18 | 0.18 | 0.85 | 0.85 | 2 | 2 | 12 | 12 | 12 | 12 |
| Water | Ad. 100 | Ad. 100 | Ad. 100 | Ad. 100 | Ad. 100 | Ad. 100 | Ad. 100 | Ad. 100 | Ad. 100 | Ad. 100 |

Figure 2:
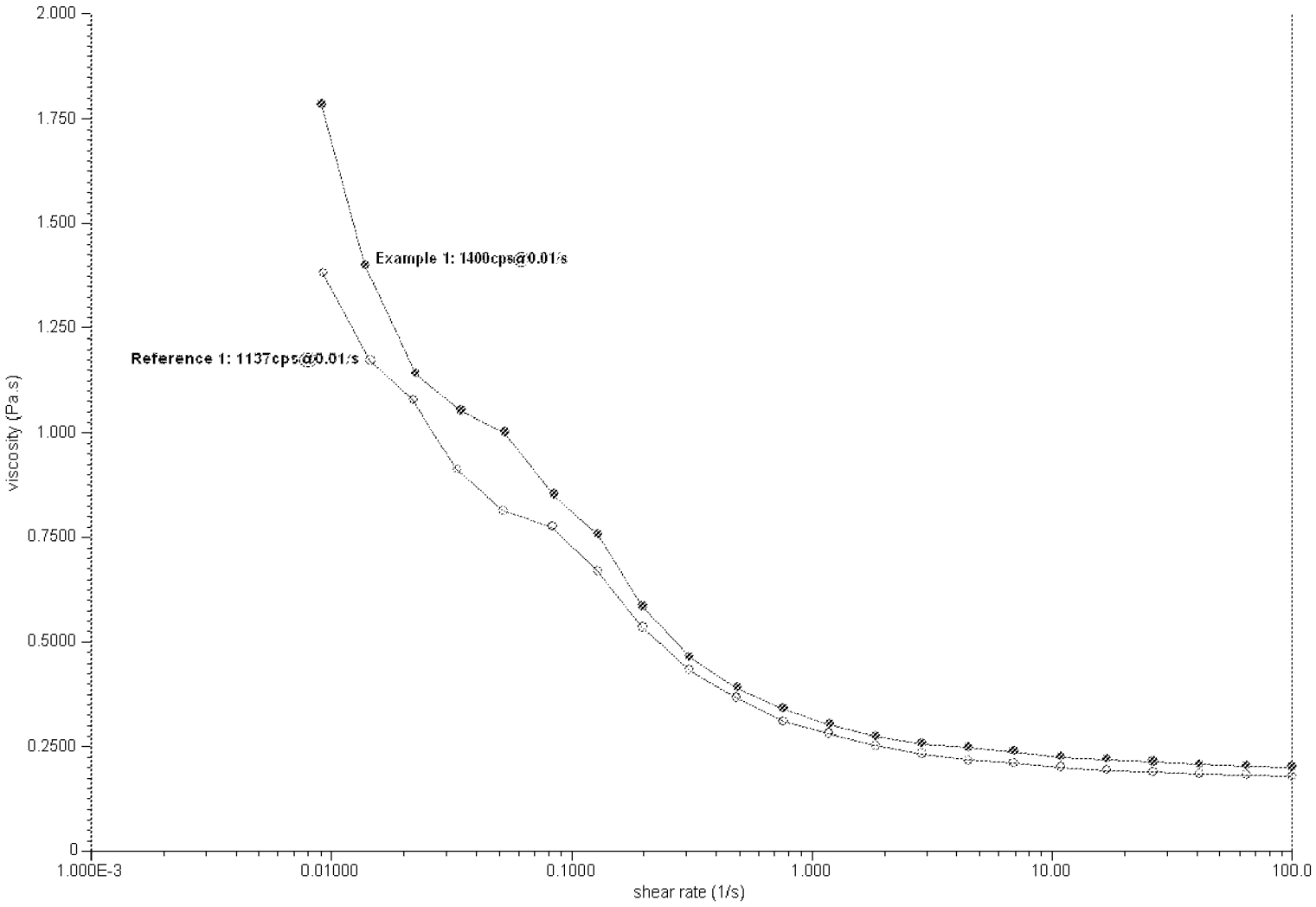
Figure 3:
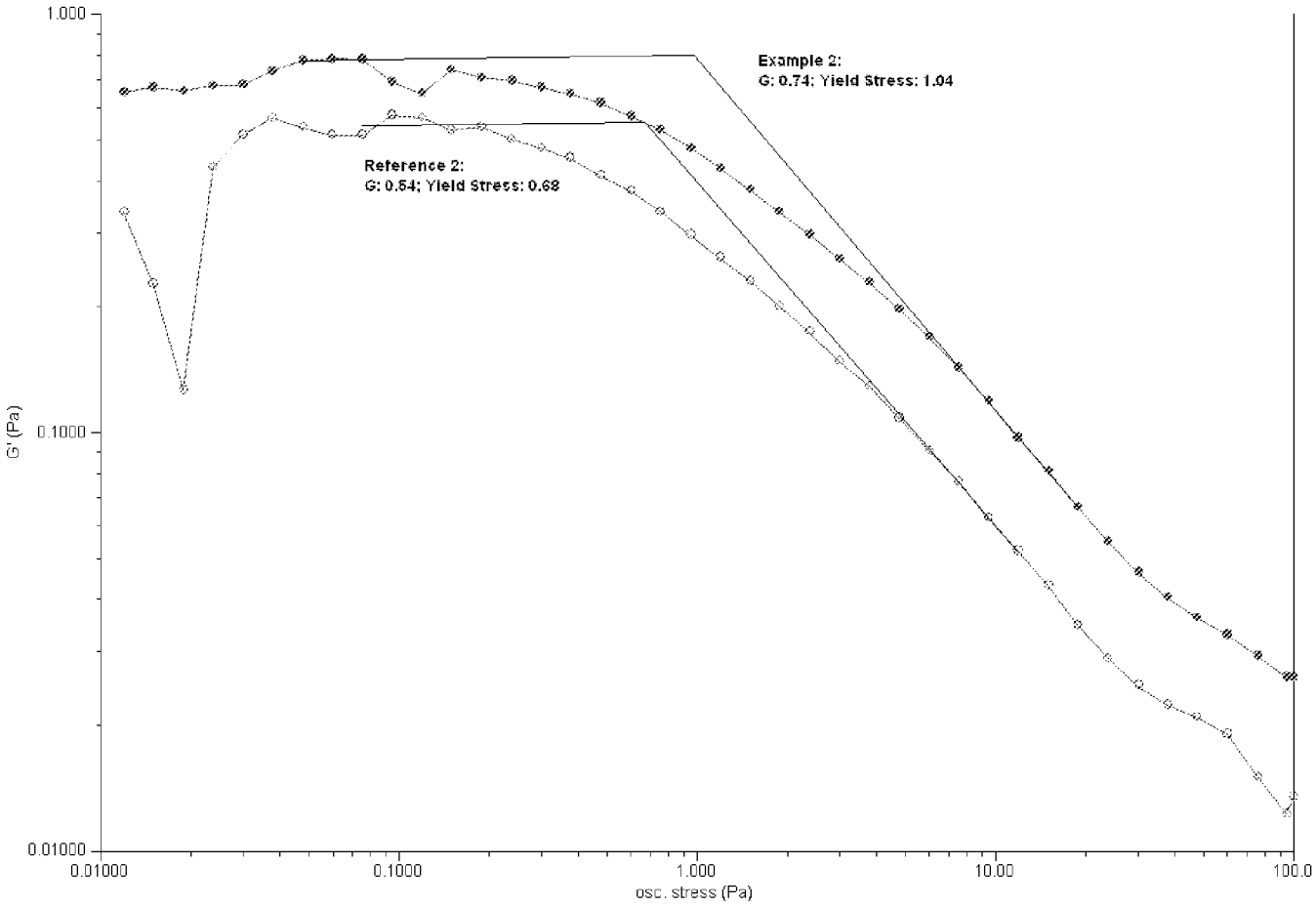
Figure 4:
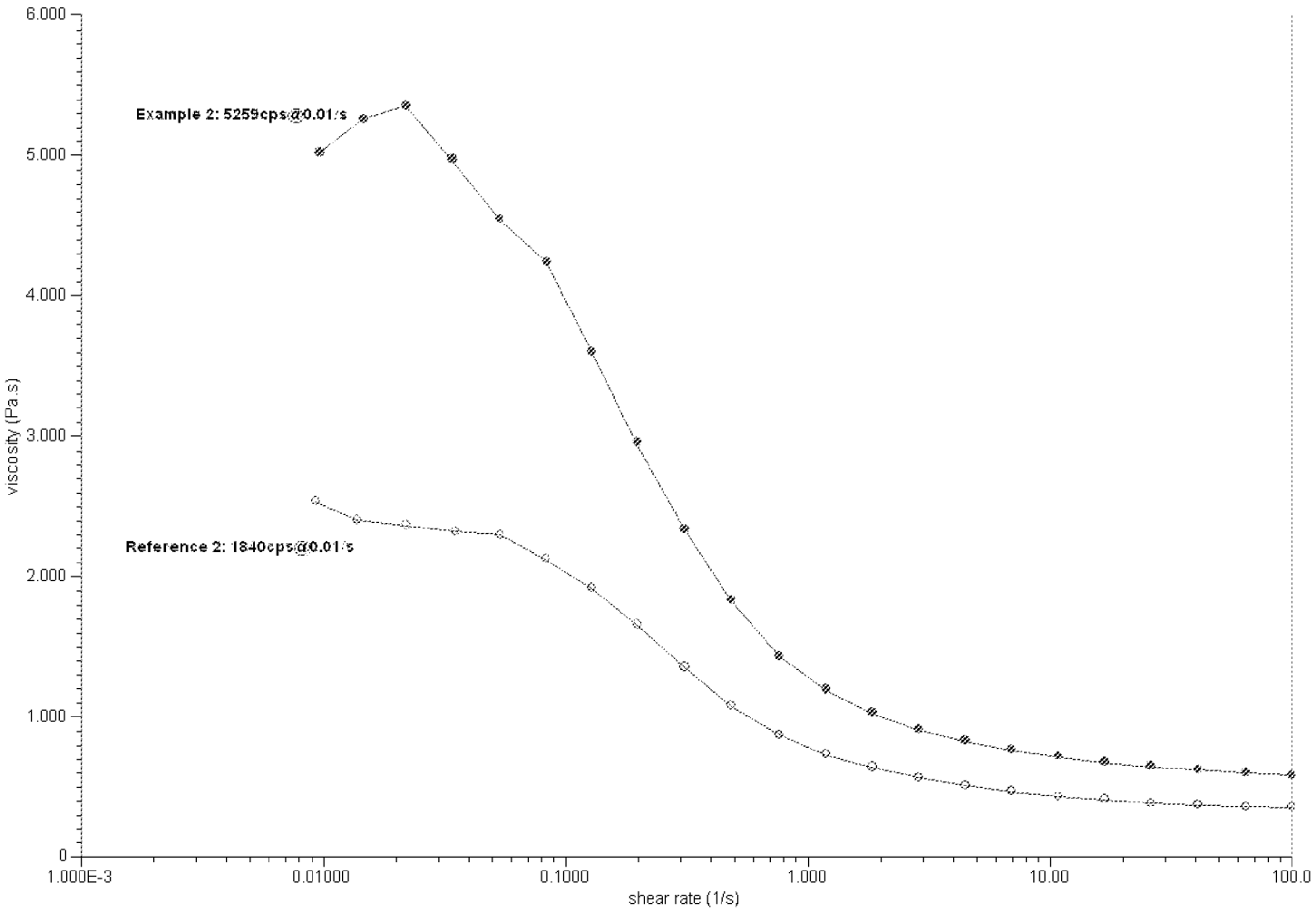
Figure 5:
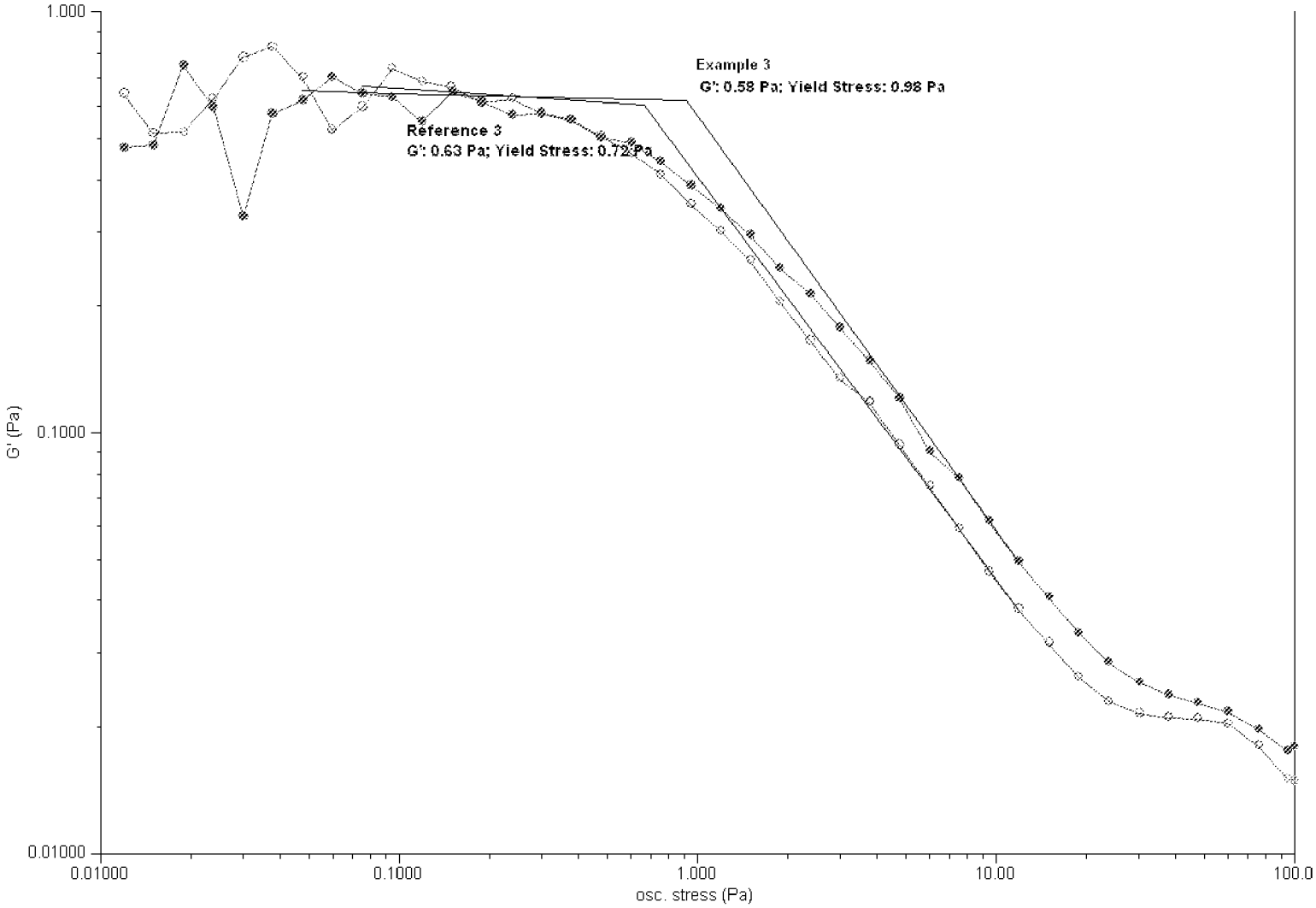
Figure 6:
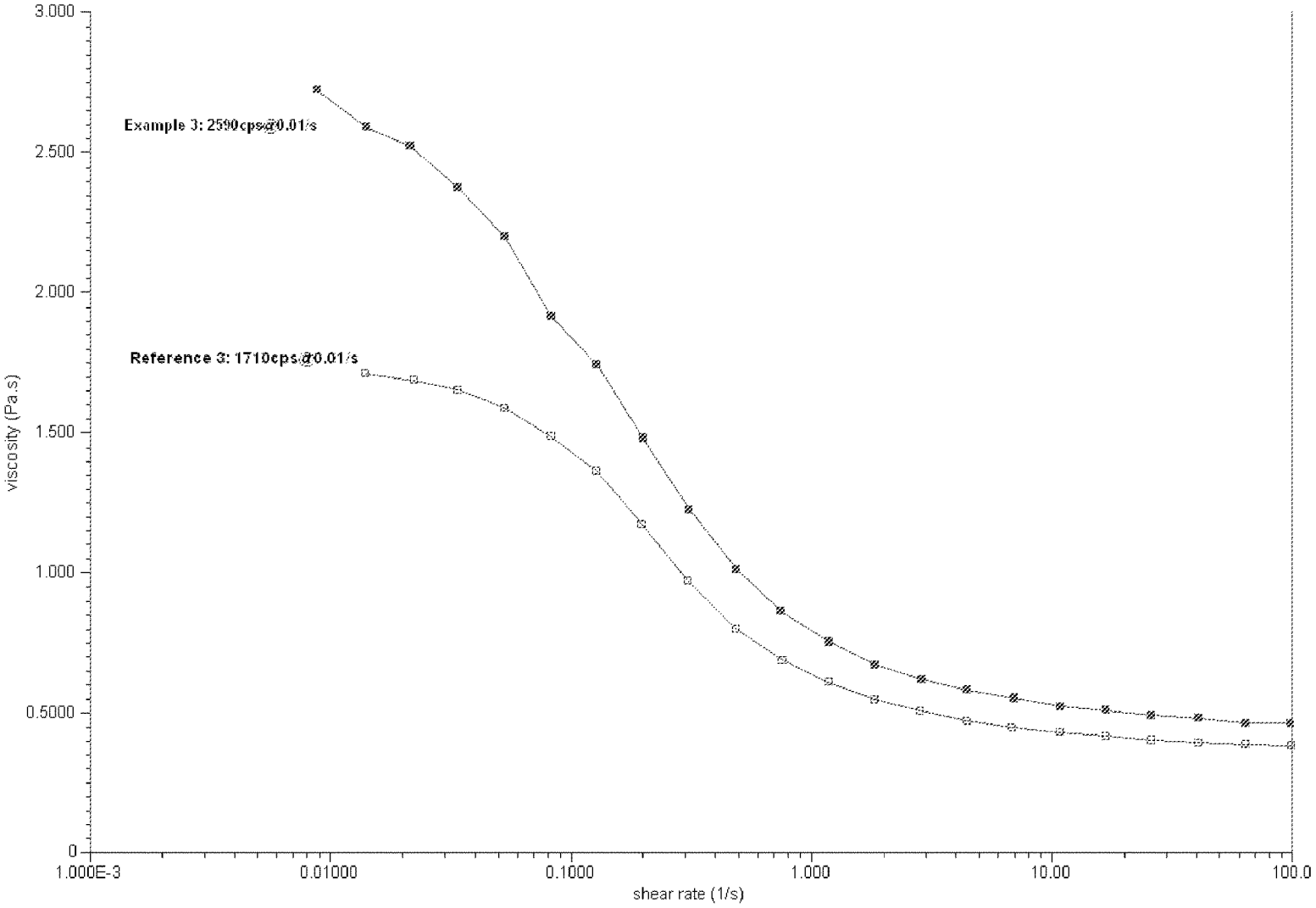
Figure 7:
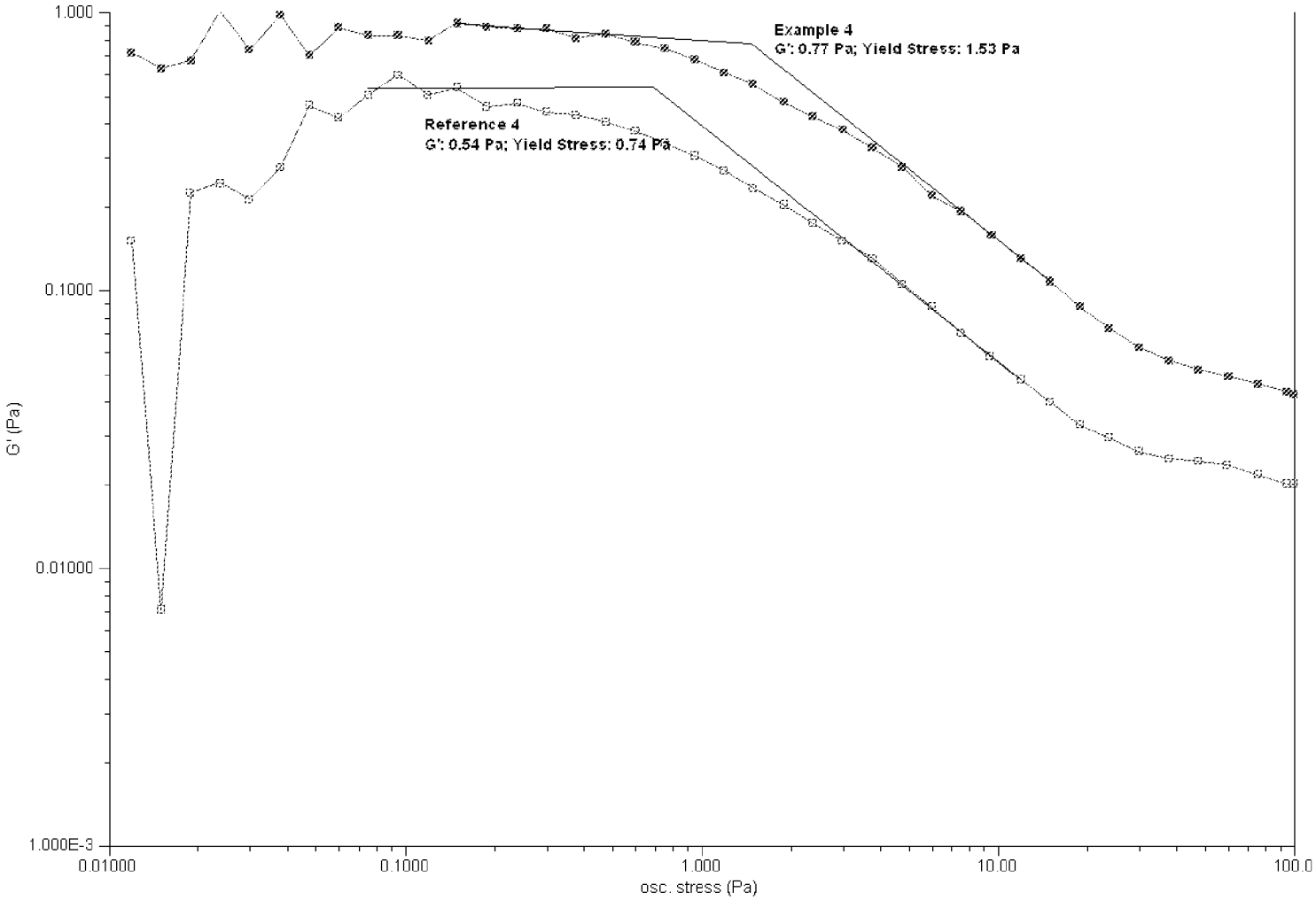
Figure 8:
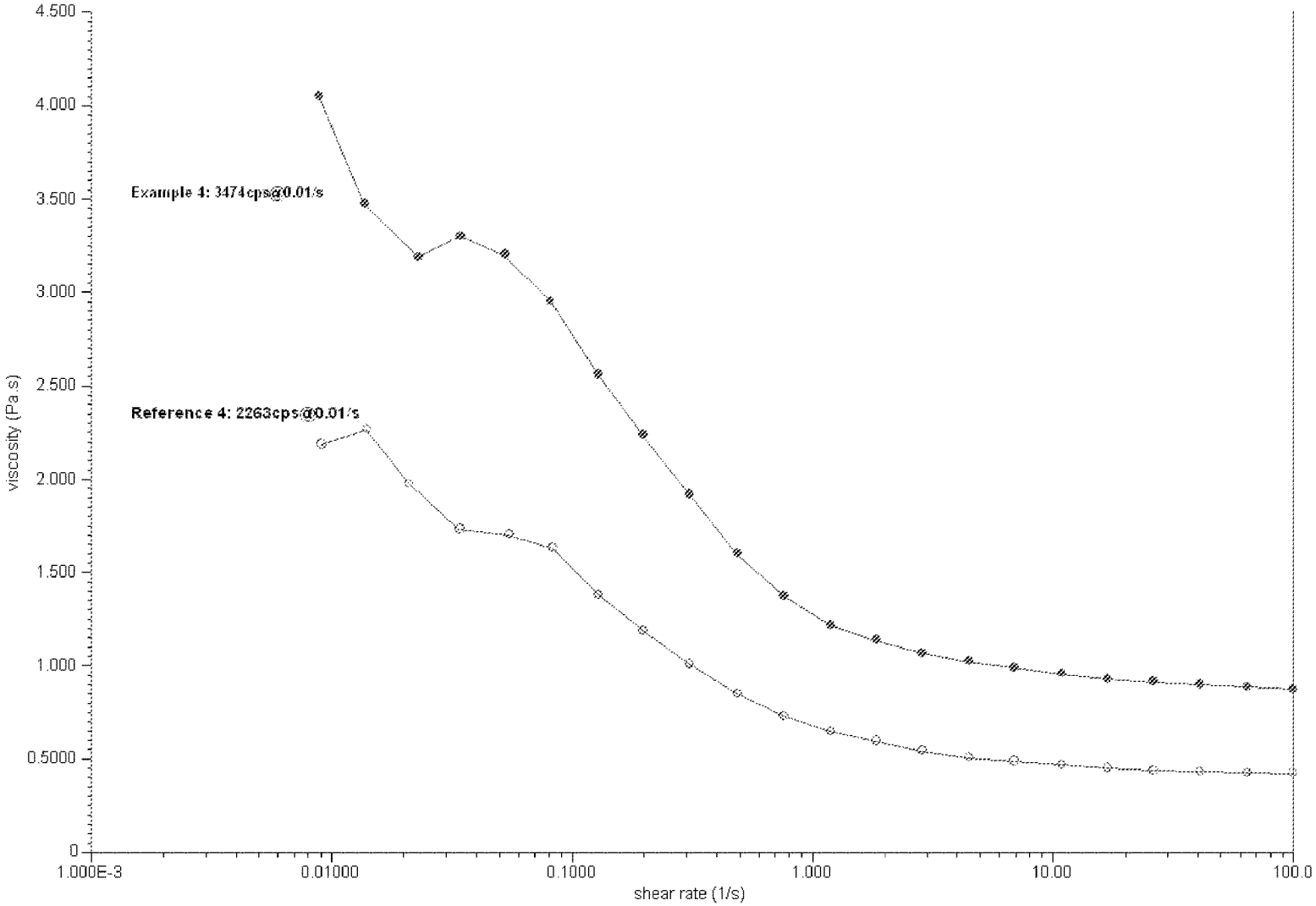
Figure 9:
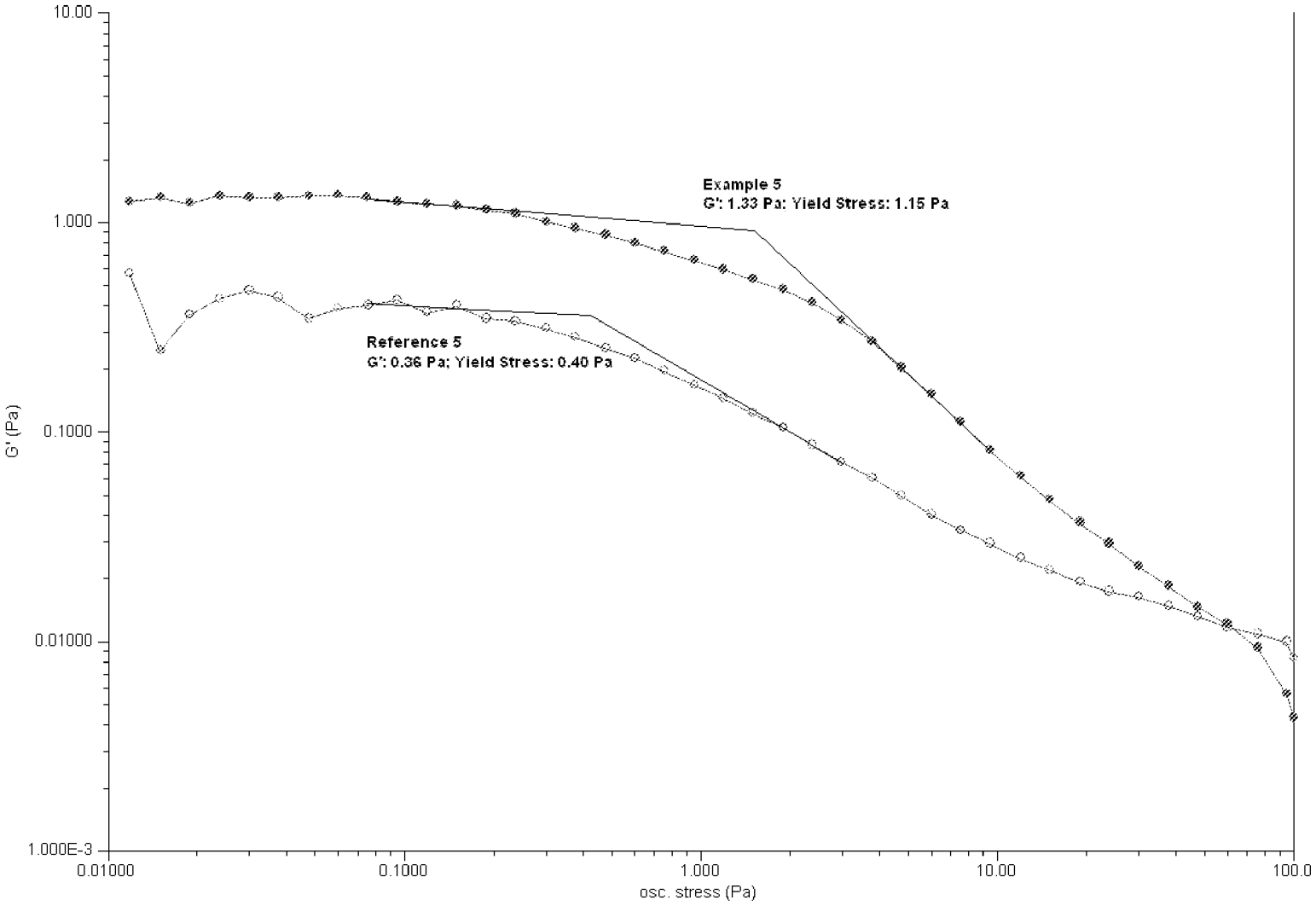
Figure 10:
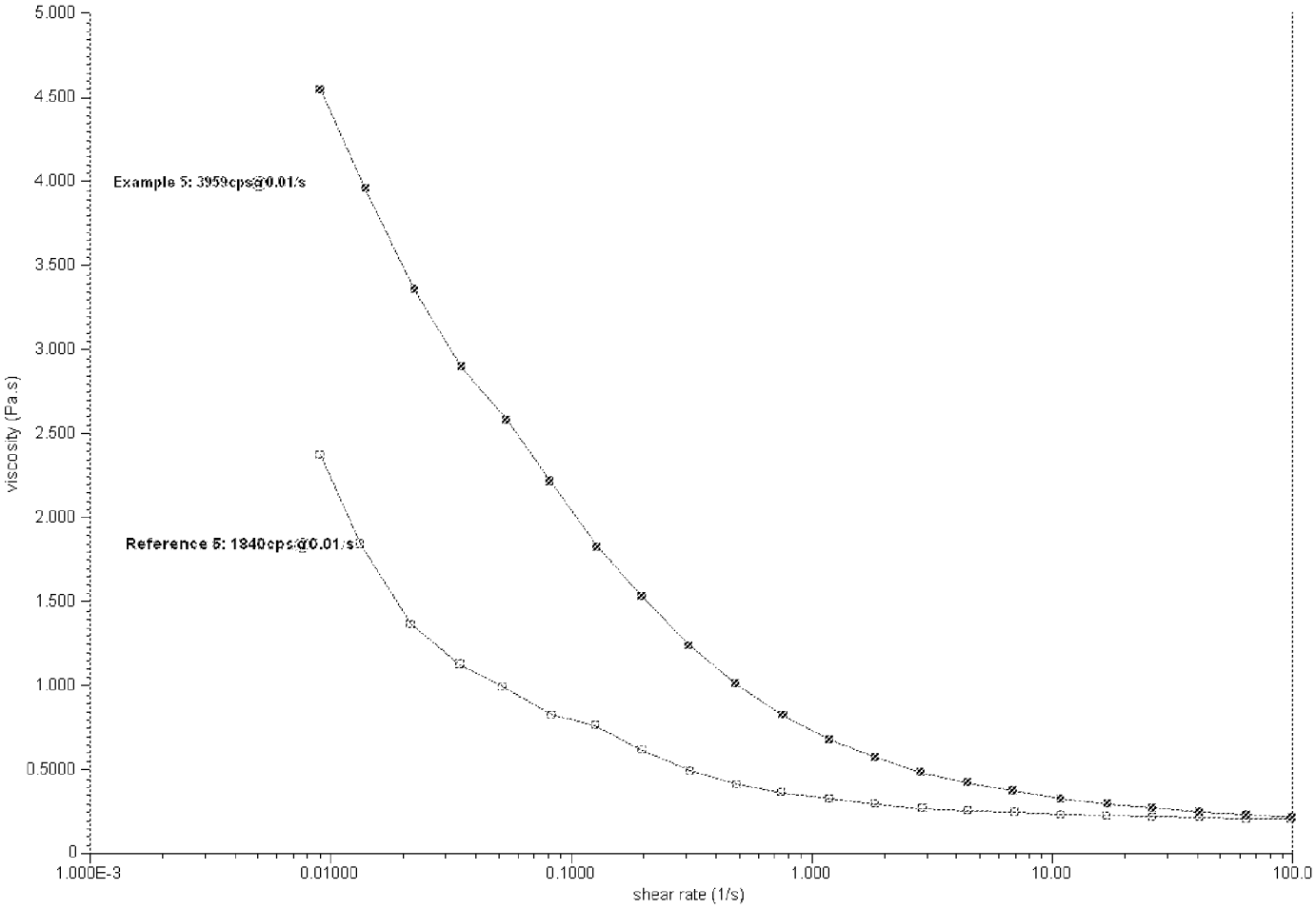

Each of the ten Examples was then tested for the rheological properties of storage modulus G', yield stress, and low-shear viscosity (0.01/s). FIG. 1 provides a graph depicting the Oscillatory Yield Stress and G' of Reference 1 and Example 1. FIG. 2 provides a graph depicting the Viscosity profile of Reference 1 and Example 1. FIG. 3 provides a graph depicting the Oscillatory Yield Stress and G' of Reference 2 and Example 2. FIG. 4 provides a graph depicting the Viscosity profile of Reference 2 and Example 2. FIG. 5 provides a graph depicting the Oscillatory Yield Stress and G' of Reference 3 and Example 3. FIG. 6 provides a graph depicting the Viscosity profile of Reference 3 and Example 3. FIG. 7 provides a graph depicting the Oscillatory Yield Stress and G' of Reference 4 and Example 4. FIG. 8 provides a graph depicting the Viscosity profile of Reference 4 and Example 4. FIG. 9 provides a graph depicting the Oscillatory Yield Stress and G' of Reference 5 and Example 5. FIG. 10 provides a graph depicting the Viscosity profile of Reference 5 and Example 5. TABLE 2 summarizes the rheological properties observed in the graphs of FIGS. 1-10:

TABLE 2

| Rheology | Reference 1 | Example 1 | Reference 2 | Example 2 | Reference 3 | Example 3 | Reference 4 | Example 4 | Reference 5 | Example 5 |
|---|---|---|---|---|---|---|---|---|---|---|
| G' | 0.23 | 0.37 | 0.54 | 0.74 | 0.63 | 0.58 | 0.54 | 0.77 | 0.36 | 1.33 |
| Yield Stress | 0.59 | 0.44 | 0.68 | 1.04 | 0.72 | 0.98 | 0.74 | 1.53 | 0.40 | 1.15 |
| Low shear viscosity (0.01/s) | 1173 | 1400 | 2404 | 5259 | 1710 | 2590 | 2263 | 3474 | 1840 | 3959 |

As shown in TABLE 2, the introduction of the CAPB surfactant results in improved rheology data (in terms of storage modulus G', yield stress and low-shear viscosity) compared to the same surfactant composition without CAPB. The improvement is more pronounced in the inventive Example compositions 2-5, which have higher anionic surfactant to nonionic surfactant ratios than Example 1. As such, the minimum such ratio in accordance with the present disclosure should be 0.5 as described above. In addition, the inventive Examples also showed better incorporation of bacterial derived cellulose compared to reference products without CAPB under the same mixing conditions (it was observed that cellulose was fully dispersed into the inventive Example compositions while there were still cellulose granules left in the reference Example compositions after 30 min overhead mixing at 280 rpm).

The inventive Example compositions 2-5 were also found surprisingly resulting into a much better incorporation of cellulose into the detergent formulation, meaning that a desired structural product can be made with a lower mixing energy or/and shorter mixing time by using the aforementioned surfactant composition. In addition, the lower amount of mixing energy and time helps to minimize air entrapment in the production that will in return improve the stability of suspending particles, oil, or air in structured liquid detergent.

Accordingly, the present disclosure has provided a structured liquid detergent composition that includes a bacterial-derived cellulose network, that delivers significantly improved structural network in terms of yield stress, storage modulus and low shear viscosity compared to what exhibited in the prior art structured liquid detergent compositions. As such, the structured liquid detergents disclosed herein are useful for significant stability improvement of particle components in liquid laundry detergent using bacterial-derived cellulose network, while at the same time requiring lower structuring agent inclusion levels for cost efficiencies compared to conventional microcrystalline cellulose that is derived from plant sources.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the subject matter in any way. Rather, the foregoing detailed description will provide those skilled in the art with a convenient road map for implementing an exemplary embodiment, it being understood that various changes may be made in the function and arrangement of elements described in an exemplary embodiment without departing from the scope as set forth in the appended claims and their legal equivalents.

What is claimed is:

1. A structured liquid detergent composition comprising:

water;

anionic detergent surfactant consisting of alcohol ether sulfate in the amount of about 1% to about 6% by weight of the detergent composition and linear alkylbenzene sulfonate in the amount of about 1% to about 11% by weight of the detergent composition;

a nonionic detergent surfactant, wherein a weight ratio of the anionic detergent surfactant to the nonionic detergent surfactant is from about 0.5 to about 15;

a zwitterionic or amphoteric detergent surfactant in an amount of about 0.1% to about 30% by weight of the detergent composition, wherein the zwitterionic or amphoteric detergent surfactant comprises cocoamidopropyl betaine (CAPB) in an amount of about 1% by weight of the detergent composition; and a bacterial-derived cellulose network present in an amount of about 0.002% to about 0.2%, by weight of the overall structured liquid detergent composition, wherein the composition has a storage modulus G' and oscillatory yield stress of from about 0.5 Pa to about 1.5 Pa.

2. The structured liquid detergent composition of claim 1, wherein the bacterial-derived cellulose network comprises a cellulose produced by fermentation of a bacteria of *Acetobacter*.

3. The structured liquid detergent composition of claim 2, wherein the bacterial-derived cellulose network comprises microfibrillated cellulose, reticulated bacterial cellulose, or a combination thereof.

4. The structured liquid detergent composition of claim 1, wherein the water is present in an amount of about 50% to about 95% by weight of the detergent composition, by weight of the overall structured liquid detergent composition.

5. The structured liquid detergent composition of claim 1, wherein the anionic detergent surfactant is present in an amount of about 1% to about 15% by weight of the detergent composition, by weight of the overall structured liquid detergent composition.

6. The structured liquid detergent composition of claim 1, wherein the nonionic detergent surfactant is present in an amount of about 1% to about 15% by weight of the detergent composition, by weight of the overall structured liquid detergent composition.

7. The structured liquid detergent composition of claim 1, wherein the zwitterionic or amphoteric detergent surfactant is present in an amount of about 0.5% to about 20% by weight of the detergent composition, by weight of the overall structured liquid detergent composition.

8. The structured liquid detergent composition of claim 1, wherein the bacterial-derived cellulose network is present in an amount of about 1% to about 3% by weight of the detergent composition, by weight of the overall structured liquid detergent composition.

9. The structured liquid detergent composition of claim 1, further comprising an additive comprising one or more of: enzymes, peroxy compounds, bleach activators, anti-redeposition agents, neutralizers, optical brighteners, foam inhibitors, chelators, dye transfer inhibitors, soil release agents, water softeners, electrolytes, pH regulators, graying inhibitors, anti-crease components, bleach agents, colorants, scents, processing aids, antimicrobial agents, and preservatives.

10. A structured liquid detergent composition comprising, by weight of the overall structured liquid detergent composition:

water in an amount of about 50% to about 95% by weight of the detergent composition;

anionic detergent surfactant in an amount of about 1% to about 15% by weight of the detergent composition, the anionic surfactant comprising alcohol ether sulfate and linear alkylbenzene sulfonate;

a nonionic detergent surfactant in an amount of about 1% to about 30% by weight of the detergent composition, wherein a weight ratio of the anionic detergent surfactant to the nonionic detergent surfactant is from about 0.5 to about 15;

a zwitterionic or amphoteric detergent surfactant in an amount of about 0.1% to about 30% by weight of the detergent composition, wherein the zwitterionic or amphoteric detergent surfactant comprises cocoamidopropyl betaine (CAPB) in an amount of about 1% by weight of the detergent composition; and a bacterial-derived cellulose network in an amount of about 0.002% to about 0.05% by weight of the detergent composition, wherein the composition has a storage modulus G' and oscillatory yield stress of from about 0.5 Pa to about 1.5 Pa.

11. A structured liquid detergent composition comprising, by weight of the overall structured liquid detergent composition:

water in an amount of about 70% to about 90% by weight of the detergent composition;

anionic detergent surfactant in an amount of about 0.5% to about 20% by weight of the detergent composition and consisting of alcohol ether sulfate and linear alkylbenzene sulfonate;

a nonionic detergent surfactant in an amount of about 5% to about 20% by weight of the detergent composition, wherein a weight ratio of the anionic detergent surfactant to the nonionic detergent surfactant is from about 0.5 to about 15;

a zwitterionic or amphoteric detergent surfactant in an amount of about 0.5% to about 20% by weight of the detergent composition, wherein the zwitterionic or amphoteric detergent surfactant comprises cocoamidopropyl betaine (CAPB) in an amount of about 1% by weight of the detergent composition;

a bacterial-derived cellulose network in an amount of about 0.005% to about 0.1% by weight of the detergent composition; and an additive comprising one or more of: enzymes, peroxy compounds, bleach activators, anti-redeposition agents, neutralizers, optical brighteners, foam inhibitors, chelators, dye transfer inhibitors, soil release agents, water softeners, electrolytes, pH regulators, graying inhibitors, anti-crease components, bleach agents, colorants, scents, processing aids, antimicrobial agents, and preservatives, wherein the composition has a storage modulus G' and oscillatory yield stress of from about 0.5 Pa to about 1.5 Pa.

* * * * *